US007557783B2

(12) United States Patent
Kim

(10) Patent No.: US 7,557,783 B2
(45) Date of Patent: Jul. 7, 2009

(54) ORGANIC LIGHT EMITTING DISPLAY

(75) Inventor: Yang Wan Kim, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 705 days.

(21) Appl. No.: 11/227,998

(22) Filed: Sep. 14, 2005

(65) Prior Publication Data

US 2006/0071884 A1 Apr. 6, 2006

(30) Foreign Application Priority Data

Sep. 22, 2004 (KR) ..... 10-2004-0075821

(51) Int. Cl.
*G09G 3/32* (2006.01)

(52) U.S. Cl. ..... 345/82; 370/542; 370/916; 345/76; 345/83; 345/98; 345/100; 345/204

(58) Field of Classification Search ..... 345/76, 345/82, 83, 98, 100, 204; 370/542, 916
See application file for complete search history.

(56) References Cited

U.S. PATENT DOCUMENTS 3,898,479 A * 8/1975 Proebsting ..... 326/88
5,686,935 A * 11/1997 Weisbrod ..... 345/100
6,404,237 B1 * 6/2002 Mathew et al. ..... 326/113
6,538,631 B1 * 3/2003 Kwon ..... 345/96
6,556,176 B1 4/2003 Okuyama et al.
6,788,108 B2 * 9/2004 Miyake et al. ..... 326/88
7,212,182 B2 * 5/2007 Chiang et al. ..... 345/92
2002/0036605 A1 3/2002 Kawashima
2003/0179164 A1 * 9/2003 Shin et al. ..... 345/76
2005/0110727 A1 * 5/2005 Shin ..... 345/76

FOREIGN PATENT DOCUMENTS

KR 2003-0096878 12/2003

* cited by examiner

*Primary Examiner*—Richard Hjerpe
*Assistant Examiner*—Gregory J Tryder
(74) *Attorney, Agent, or Firm*—Christie Parker & Hale LLP

(57) ABSTRACT

An organic light emitting display capable of reducing the manufacturing cost and displaying images with uniform brightness. The organic light emitting display includes: a data driver for supplying a plurality of data signals to a plurality of first data lines, respectively; an image display portion having a plurality of second data lines, a plurality of scan lines, and a plurality of pixels; and a demultiplexer having a plurality of data transistors arranged in the respective first data lines to supply the plurality of data signals supplied to the first data lines to the plurality of second data lines, and a plurality of capacitors connected between respective gate terminals of the plurality of data transistors and the second data lines.

14 Claims, 14 Drawing Sheets

ORGANIC LIGHT EMITTING DISPLAY

CROSS-REFERENCE TO RELATED APPLICATIONS

This application claims the priority of Korean Patent Application No. 2004-75821, filed on Sep. 22, 2004, in the Korean Intellectual Property Office, the entire disclosure of which is incorporated herein by reference.

FIELD OF THE INVENTION

The present invention relates to an organic light emitting display and a driving method thereof and, more specifically, to a demultiplexer, an organic light emitting display using the same, and a driving method thereof, capable of reducing the manufacturing cost and displaying images with uniform brightness.

BACKGROUND

Recently, various flat panel displays have been developed to compensate for weight and volume drawbacks of a cathode ray tube. There are different types of flat panel displays, such as liquid crystal displays, field emission displays, plasma display panels, and organic light emitting displays.

Among these flat panel displays, an organic light emitting display can emit light by recombination of electrons and holes. The organic light emitting display has advantages of fast response time as well as low power consumption. A typical organic light emitting display emits light by using a thin film transistor (hereinafter, referred to as a 'TFT') arranged in each pixel to supply a current to the light emitting diode.

FIG. 1 is a diagram showing a typical organic light emitting display according to a prior art. Referring to FIG. 1, the conventional organic light emitting display includes an image display portion 30 having pixels 40 formed at intersection regions between scan lines S1 to Sn and data lines D1 to Dm; a scan driver 10 for driving the scan lines S1 to Sn; a data driver 20 for driving the data lines D1 to Dm; and a timing controller 50 for controlling the scan driver 10 and the data driver 20.

The scan driver 10 generates scan signals in response to scanning drive control signals SCS from the timing controller 50, and sequentially provides the generated scan signals to the scan lines S1 to Sn. In addition, the scan driver 10 generates light control signals in response to the scanning drive control signals SCS and sequentially provides the generated light control signals to light emitting control lines E1 to En.

The data driver 20 generates data signals in response to data drive control signals DCS from the timing controller 50, and supplies the generated data signals to the data lines D1 to Dm. Here, the data driver 20 supplies the data signals of each horizontal line to the data lines D1 to Dm for each horizontal period.

The timing controller 50 generates the data timing control signals and the scanning drive control signals SCS in response to sync signals supplied externally. The data drive control signals DCS generated from the timing controller 50 are supplied to the data driver 20, and the scanning drive control signals SCS are supplied to the scan driver 10. Further, the timing controller 50 supplies external data to the data driver 20.

The image display portion 30 receives a first power supply voltage VDD and a second power supply voltage VSS. Here, the first power supply voltage VDD and the second power supply voltage VSS are both supplied to the respective pixels 40. Each pixel 40 displays an image corresponding to a respective data signal. Further, A light emitting time of the pixels 40 is controlled in response to the light emitting control signals.

In the conventional organic light emitting display driven as described above, the pixels 40 are respectively arranged at the intersection regions between the scan lines S1 to Sn and the data lines D1 to Dm. Here, the data driver 20 includes m output lines to supply data signals to the m data lines D1 to Dm, respectively. In other words, according to the conventional organic light emitting display, the data driver 20 should have as many output lines as the data lines D1 to Dm. Therefore, a number of data circuits are needed such that the data driver 20 has m output lines. This causes an increase in manufacturing cost. In particular, as the resolution and size of the image display portion 30 are increased, the data driver 20 needs to have more output lines, and accordingly, the manufacturing cost is increased.

SUMMARY OF THE INVENTION

In one embodiment, the present invention provides a demultiplexer, an organic light emitting display using the same, and a driving method thereof, capable of reducing the manufacturing cost and displaying images with uniform brightness.

One embodiment of the present invention provides an organic light emitting display including: a data driver for supplying a plurality of data signals to a plurality of first data lines, respectively; an image display portion having a plurality of second data lines, a plurality of scan lines, and a plurality of pixels, each pixel arranged at intersection of a respective second data line and a respective scan line; and a plurality of demultiplexers, each demultiplexer coupled to a respective first data line and having a data transistor to supply a respective data signal to a respective second data line responsive to the respective first data line, and a capacitor connected between gate terminal of the data transistor and the respective second data line.

The capacitor may be connected between the gate terminal and a drain terminal of each data transistor. Each data transistor may include i data transistors (where, i is a natural number of 2 or more), and the organic light emitting display may further include a demultiplexer controller for sequentially turning on the i data transistors while the scan signals are supplied to the scan lines. The capacitors connected to the respective gate terminals of the i data transistors may have different capacitances from each other. In one embodiment, the capacitance of a respective capacitor is larger as the respective capacitor is turned on later in the sequence.

Another embodiment of the present invention is to provide a demultiplexer including: a plurality of transistors respectively connected to a plurality of data lines to supply data signals supplied from the external to a plurality of data lines; and a plurality of capacitors each connected between a gate terminal of a respective transistor and a respective data line, wherein each of the capacitors has different capacitances.

The plurality of transistors may be sequentially turned on to supply the data signals to the plurality of data lines. In one embodiment, the capacitance of a respective capacitor increases in value as the respective capacitor is turned on later in the sequence.

Yet another embodiment of the present invention is to provide a method of driving an organic light emitting display, including: sequentially turning on a plurality of transistors to supply a plurality of data signals applied to one output signal to a plurality of data lines; and sequentially turning off each of the plurality of transistors to sequentially increase respective voltages supplied to the data lines, wherein a respective voltage associated with a respective transistor is set to be higher than the voltage associated with a second transistor that is turned off after the first transistor.

In one embodiment, the present invention is a method for driving an organic light emitting display. The method includes multiplexing a first data line to a plurality of second data lines for sequentially driving respective light emitting diodes; and sequentially increasing a voltage of a next second data line of the plurality of second data line before the next second data line drives a respective light emitting diode to compensate for current variations of the respective light emitting diode.

BRIEF DESCRIPTION OF THE DRAWINGS

These and/or other aspects and advantages of the invention will become apparent and more readily appreciated from the following description of various embodiments, taken in conjunction with the accompanying drawings of which.

DETAILED DESCRIPTION

Figure 1:
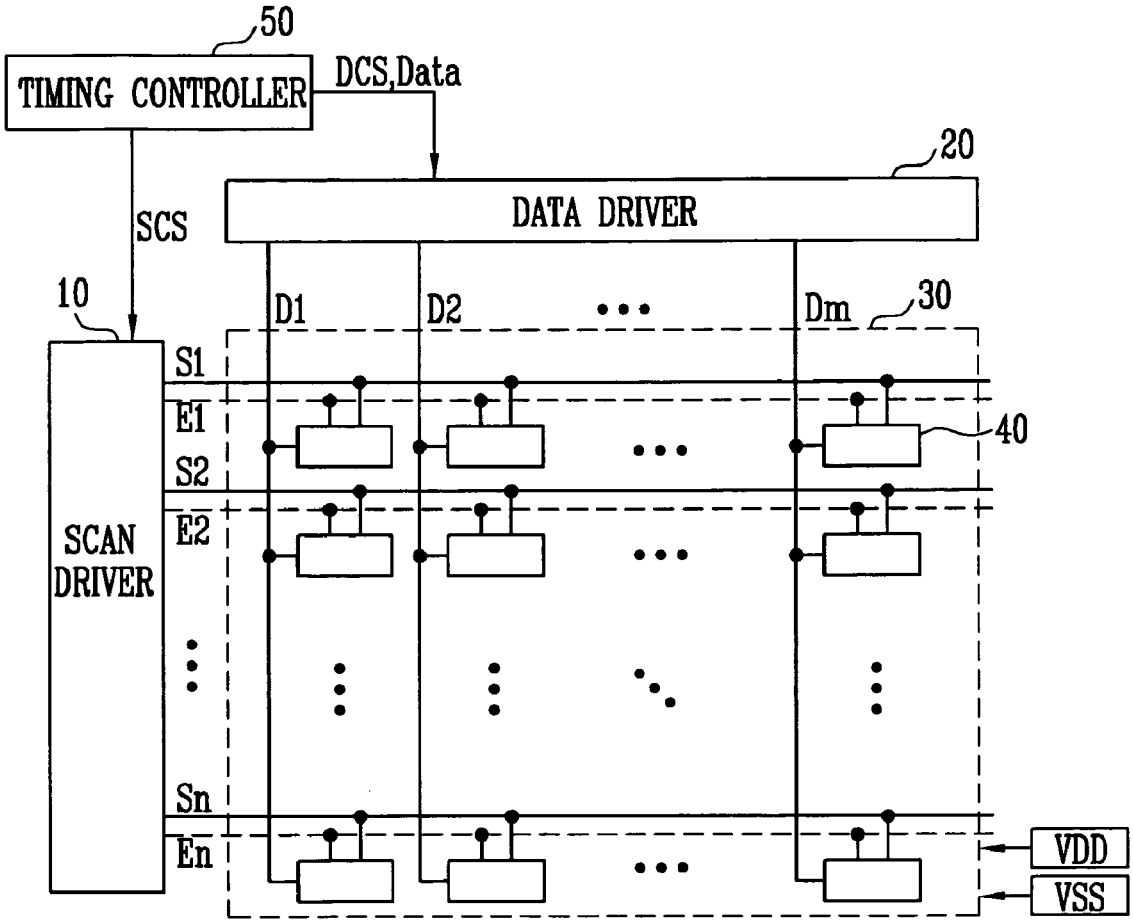
FIG. 1 (PRIOR ART)
FIG. 1 is a diagram showing an organic light emitting display according to prior art.
Figure 2:
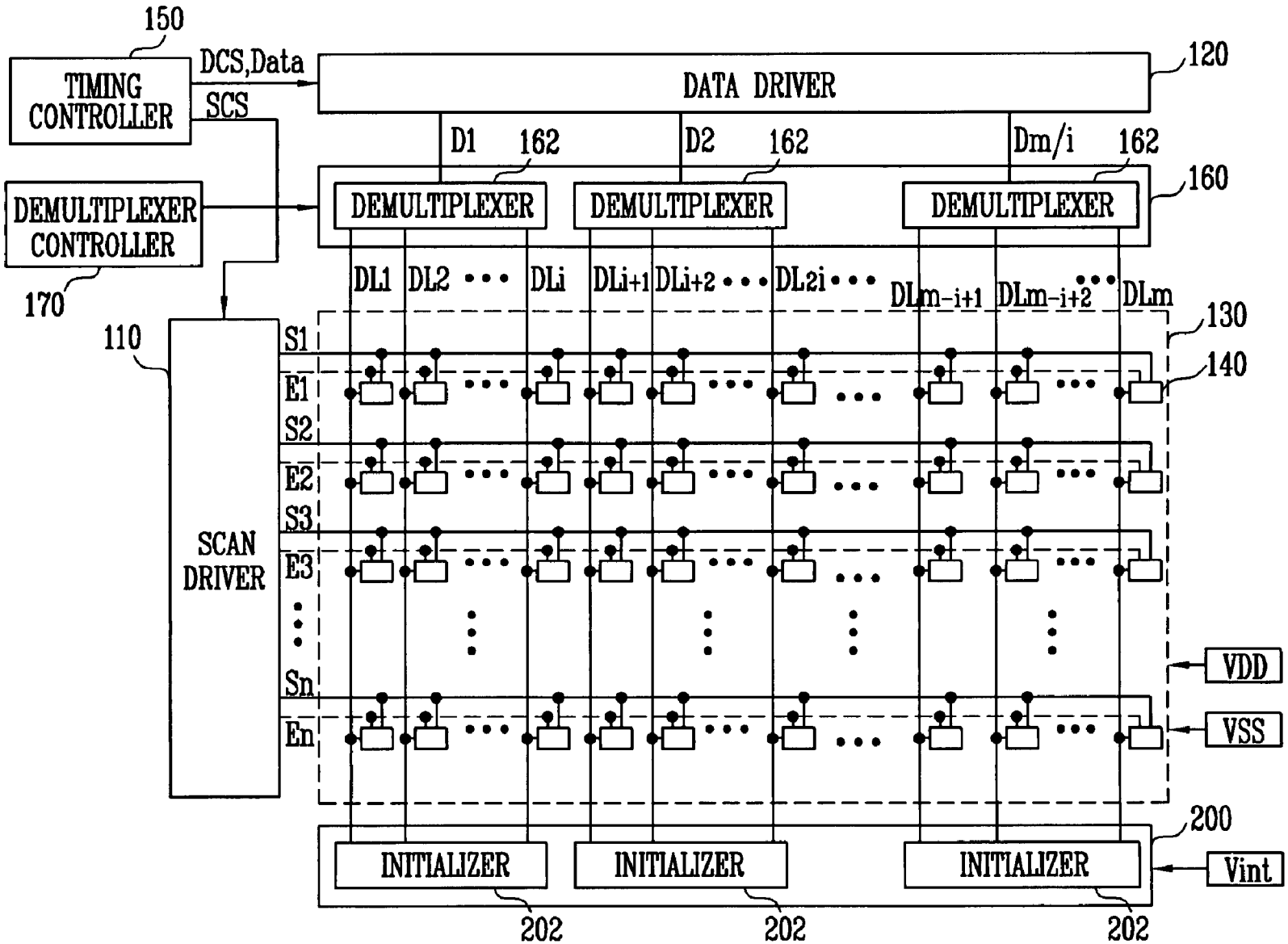
FIG. 2 is a diagram showing an organic light emitting display according to an embodiment of the present invention.

FIG. 2 is a diagram showing an organic light emitting display according to an embodiment of the present invention. Referring to FIG. 2, the organic light emitting display includes a scan driver 110, a data driver 120, an image display portion 130, a timing controller 150, a demultiplexer block 160, a demultiplexer controller 170, and an initialization block 200.

The image display portion 130 includes a plurality of pixels 140 arranged at regions intersected by scan lines S1 to Sn and second data lines DL1 to DLm. Each of the pixels 140 emits light corresponding to a data signal supplied from a respective second data line DL.

The scan driver 110 generates scan signals in response to scanning drive control signals SCS supplied from the timing controller 150, and sequentially supplies the generated scan signals to the scan lines S1 to Sn. In addition, the scan driver 110 generates light emitting control signals in response to the scanning drive control signals SCS, and sequentially supplies the generated light emitting control signals to light emitting control lines E1 to En.

The data driver 120 generates data signals in response to data drive control signals DCS supplied from the timing controller 150, and supplies the generated data signals to the respective data lines D1 to Dm/i. The data driver 120 supplies i data signals (where i is a natural number greater than one) to the first data lines D1 to Dm/i, respectively.

The timing controller 150 generates the data drive control signals DCS and the scanning drive control signals SCS in response to sync signals (not shown) supplied externally. The data drive control signals DCS generated from the timing controller 150 are supplied to the data driver 120, and the scanning drive control signals SCS are supplied to the scan driver 110. Further, the timing controller 150 supplies external data to the data driver 120.

The demultiplexer block 160 includes m/i demultiplexers 162. In other words, the demultiplexer block 160 includes as many demultiplexers as the number of first data lines D1 to Dm/i, and each demultiplexer 162 is connected to a respective first data line.

Further, each demultiplexer 162 is connected to i second data lines DL. Each demultiplexer 162 sequentially supplies the data signals supplied to the respective first data line to a corresponding i second data lines DL for each horizontal period. In other words, the demultiplexer 162 supplies the data signals supplied to one first data line D to the i second data lines DL. As a result, the number of output lines included in the data driver 120 is rapidly reduced. For example, assuming that i is 3, the number of output lines of the data driver 120 is reduced to ⅓ of the number of first data lines and thus the number of data integration circuits included in the data driver 120 is also reduced. In other words, according to the present invention, the data signals supplied to the one first data line D using a respective demultiplexer are advantageously supplied to the pixels to reduce the manufacturing cost.

The initialization block 200 includes m/i initializers 202. In other words, the initialization block portion 200 includes as many initializers 202 as the number of first data lines D1 to Dm/i. Each initializer 202 is connected to a respective one of the first data lines D1 to Dm/i.

In addition, each initializer 202 is connected to a respective group of i second data lines DL. Each initializer 202 described above supplies a respective second data line DL to an initialization power supply voltage Vint (a predetermined power supply voltage) for each one horizontal period. Here, the horizontal periods are different from each other.

The demultiplexer controller 170 supplies i control signals to the respective demultiplexers 162 for each one horizontal period. The demultiplexer controller 170 supplies the control signals such that the data signals supplied to one first data line D are supplied to a respective group of i second data lines DL. Further, the demultiplexer controller 170 supplies i initialization control signals to the respective initializers 202 for one horizontal period. The demultiplexer controller 170 supplies the initial control signals such that the voltage Vint supplied to the second data lines connected to the respective initializers 202 are applied at different times. Further, while the demultiplexer controller 170 shown in FIG. 2 is arranged outside the timing controller 150, the demultiplexer controller 170 may be inside the timing controller 150, according to an embodiment of the present invention.

Figure 3:
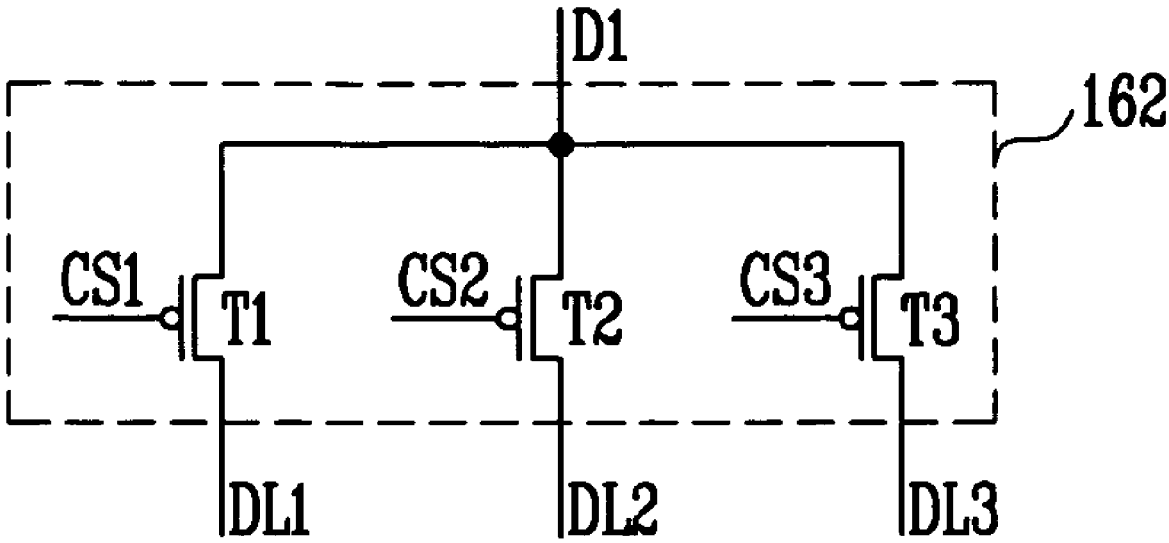
FIG. 3 is a detailed circuit diagram showing the demultiplexer shown in FIG. 2.

FIG. 3 is a diagram showing an exemplary inner circuit of the demultiplexer shown in FIG. 2. For the convenience of illustration, assume that i is 3 in FIG. 3. In addition, assume that the demultiplexer shown in FIG. 3 is a demultiplexer connected to the first one of the first data line D1.

Referring to FIG. 3, each demultiplexer 162 includes a first switching device (or transistor) T1, a second switching device T2, and a third switching device T3. The first switching device T1 is arranged between the first one of the first data line D1 and the first one of the second data line DL1, and supplies the data signals supplied to the first one of the first data line D1 to the first one of the second data line DL1. The first switching device is driven by the first control signal CS1 supplied from the demultiplexer controller 170.

The second switching device T2 is arranged between the first one of the first data line D1 and the second one of the second data line DL2, and supplies the data signals supplied to the first one of the first data line D1 to the second one of the second data line DL2. The second switching device is driven by the second control signal CS2 supplied from the demultiplexer controller 170.

Figure 4:
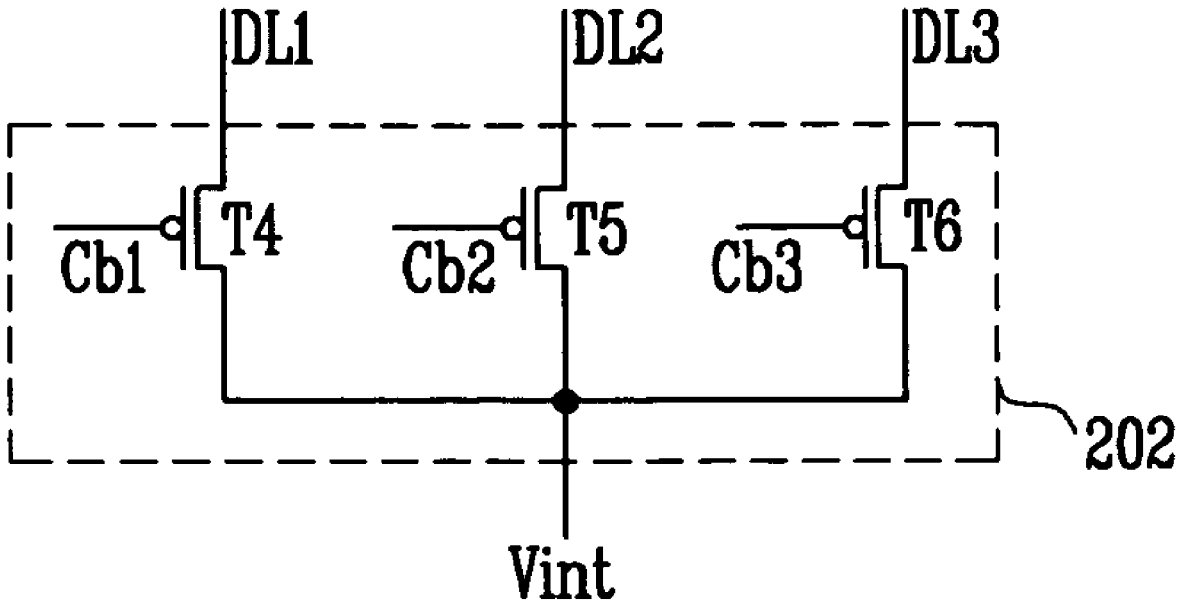
FIG. 4 is a detailed circuit diagram showing the initializer shown in FIG. 2.

The third switching device T3 is arranged between the first one of the first data line D1 and the third one of the second data line DL3, and supplies the data signals supplied to the first one of the first data line D1 to the third one of the second data line DL2. The third switching device is driven by the third control signal CS3 supplied from the demultiplexer controller 170. A detailed operation of the demultiplexer 162 described above is described below. FIG. 4 is a diagram showing an exemplary inner circuit diagram of the initializer 202 shown in FIG. 2. For the convenience of illustration, assume that i is 3 in FIG. 4. In addition, assume that the initializer shown in FIG. 4 is an initializer connected to the first to third second data lines DL1 to DL3.

Referring to FIG. 4, each initializer 202 includes initialization switching devices T4 to T6, such as a fourth switching device (or transistor) T4, a fifth switching device T5, and a sixth switching device T6.

The fourth switching device T4 is arranged between the initialization power supply voltage Vint and the first one of the second data line DL1, and supplies the voltage Vint to the first one of the second data line DL1. The switching device T4 is driven by a first initialization control signal Cb1 supplied from the demultiplexer controller 170.

The fifth switching device T5 is arranged between the voltage Vint and the second one of the second data line DL2, and supplies the voltage Vint to the second one of the second data line DL2. The switching device T5 is driven by a second initialization control signal Cb2 supplied from the demultiplexer controller 170.

Similarly, the sixth switching device T6 is arranged between the voltage Vint and the third one of the second data line DL3, and supplies the voltage Vint to the third one of the second data line DL3. The switching device T6 is driven by a third initialization control signal Cb3 supplied from the demultiplexer controller 170.

Figure 5:
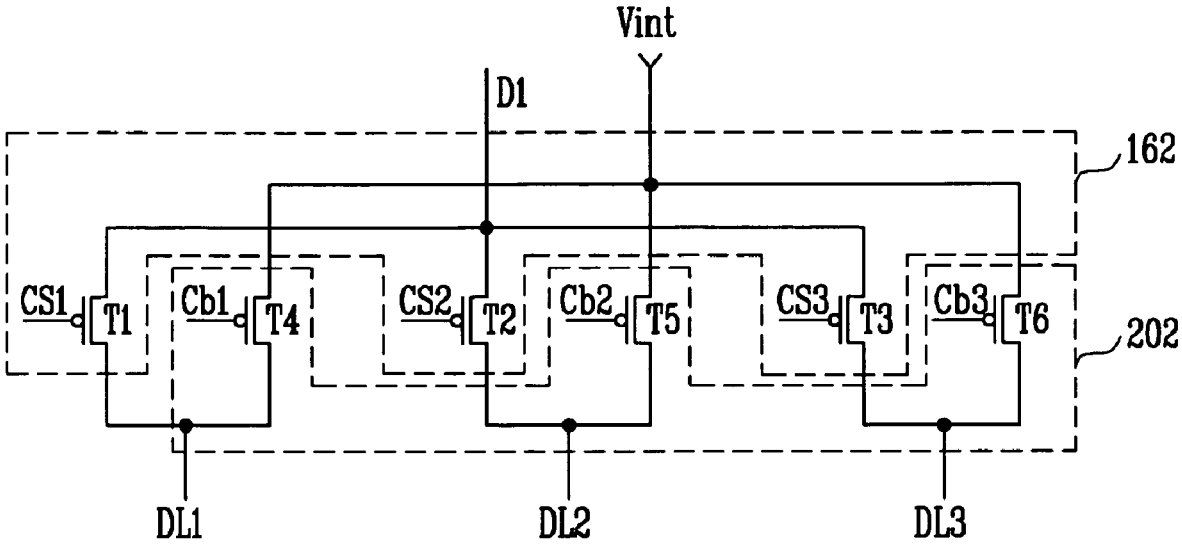
FIG. 5 is a diagram showing an arrangement where a demultiplexer and an initializer are arranged adjacent to each other.

In one embodiment, the initialization switching devices T4, T5, and T6 included in the initializer 202 of the present invention may be arranged adjacent to the data switching devices T1, T2, and T3 included in the demultiplexer 162. Here, the operation of the demultiplexer process is the same whether the initialization switching devices T4, T5, and T6 are adjacent to the data switching devices T1, T2, and T3 or separated therefrom. For now, it is assumed that the initialization switching devices T4, T5, and T6 are adjacent to each other. A demultiplexer and an initializer arranged adjacent to each other are shown in FIG. 5.

Figure 6:
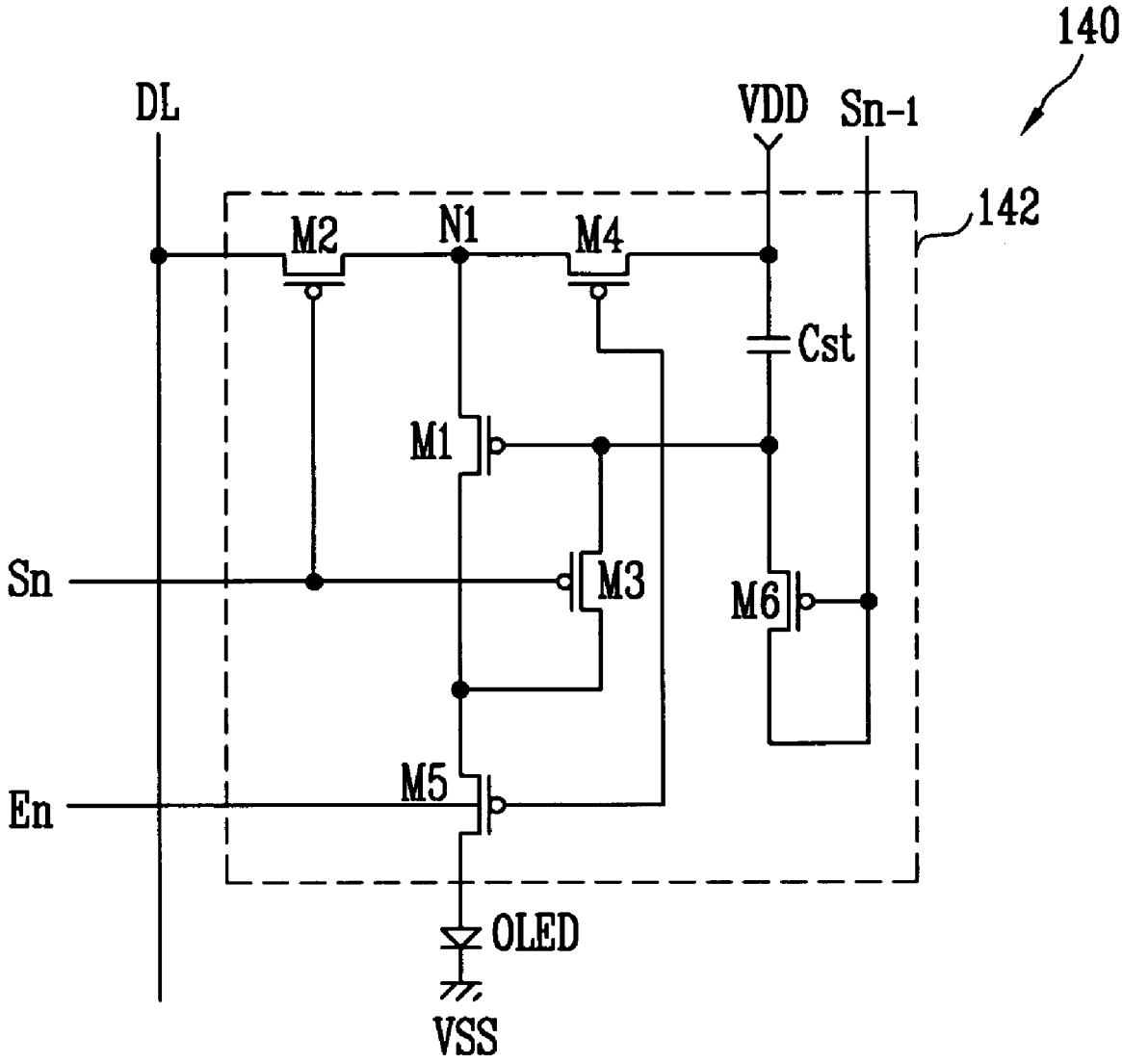
FIG. 6 is a diagram showing an embodiment of a pixel shown.

FIG. 6 is a circuit diagram showing an exemplary embodiment of the pixel shown in FIG. 2. According to one embodiment of the present invention, all pixels 140 may be substantially adapted to an arrangement where at least one transistor among the transistors included in a respective pixel 140 may be configured as a diode. Here, before the data signals are applied to the pixels 140, a predetermined voltage is supplied such that a forward bias voltage is applied to the transistor configured as the diode. Referring to FIG. 6, each of the pixels 140 includes a light emitting diode (OLED), a pixel circuit 142 connected to a second data line DL, a scan line S, and a light emitting control line E for driving the light emitting diode (OLED).

The light emitting diode (OLED) has an anode electrode connected to the pixel circuit 142 and a cathode electrode connected to a second power supply voltage VSS. The second power supply voltage VSS may be a voltage, for example a ground voltage, lower than the first power supply voltage VDD. The light emitting diode (OLED) generates light corresponding to a current supplied from the pixel circuit 142. The light emitting diode (OLED) may include fluorescent and/or phosphorescent organic material.

The pixel circuit 142 includes a storage capacitor Cst and a sixth transistor M6 connected between the first power supply voltage VDD and the n−1th scan line Sn−1; a second transistor M2 and a fourth transistor M4 connected between the first power supply voltage VDD and the data line DL; and a fifth transistor M5 connected to the light emitting diode (OLED) and the light emitting control line En. The pixel circuit 142 also includes a first transistor M1 connected between the fifth transistor M5 and a first node N1 that is a common point of the second transistor M2 and the fourth transistor M4; and a third transistor M3 connected between the gate terminal and the drain terminal of the first transistor M1 and controlled by the nth scan line Sn. While the first to sixth transistors M1 to M6 are shown as p-type MOSFETs in FIG. 6, the present invention is not limited hereto. However, if the first to sixth transistors M1 to M6 are N-type MOSFETs, polarities of driving waveforms will be inverted.

The first transistor M1 has a source terminal connected to the first node N1 and a drain terminal connected to a source terminal of the fifth transistor M5. Further, the first transistor M1 has its gate terminal connected to a first terminal of the storage capacitor Cst. The first transistor M1 supplies the current corresponding to a voltage charged in the storage capacitor Cst to the light emitting diode (OLED).

The third transistor M3 has a drain terminal connected to the gate terminal of the first transistor M1 and a source terminal connected to the drain terminal of the first transistor M1. Further, the third transistor M3 has its gate terminal connected to the nth scan line Sn. The third transistor M3 connected as a diode configuration is turned on when the scan signal is supplied to the nth scan line Sn.

The second transistor M2 has a source terminal connected to the data line DL and a drain terminal connected to the first node N1. Further, the second transistor M2 has a gate terminal connected to the nth scan line Sn. The second transistor M2 is turned on when the scan line is supplied to the nth scan line Sn, and supplies the data signals supplied to the respective data line DL to the first node N1.

The fourth transistor M4 has a drain terminal connected to the first node N1 and a source terminal connected to the first power supply voltage VDD. Further, the fourth transistor M4 has a gate terminal connected to the light emitting control line E. The fourth transistor M4 is turned on when the light emitting control signal is not supplied (i.e., in a low state), and electrically connects the first node N1 to the first power supply voltage VDD.

The fifth transistor M5 has a source terminal connected to the drain terminal of the first transistor M1 and a drain terminal connected to the light emitting diode (OLED). Further, the fifth transistor M5 has a gate terminal connected to the light emitting control line E. The fifth transistor M5 is turned on when the light emitting control signal is not supplied, and supplies the current supplied from the first transistor M1 to the light emitting diode (OLED).

The sixth transistor M6 has a source terminal connected to the first terminal of the storage capacitor Cst, and a drain terminal and a gate terminal connected to the n−1th (previous) scan line Sn−1. The sixth transistor M6 is turned on when the scan signal is supplied to the n−1th scan line Sn−1, to initialize the storage capacitor and the gate terminal of the first transistor.

Figure 7:
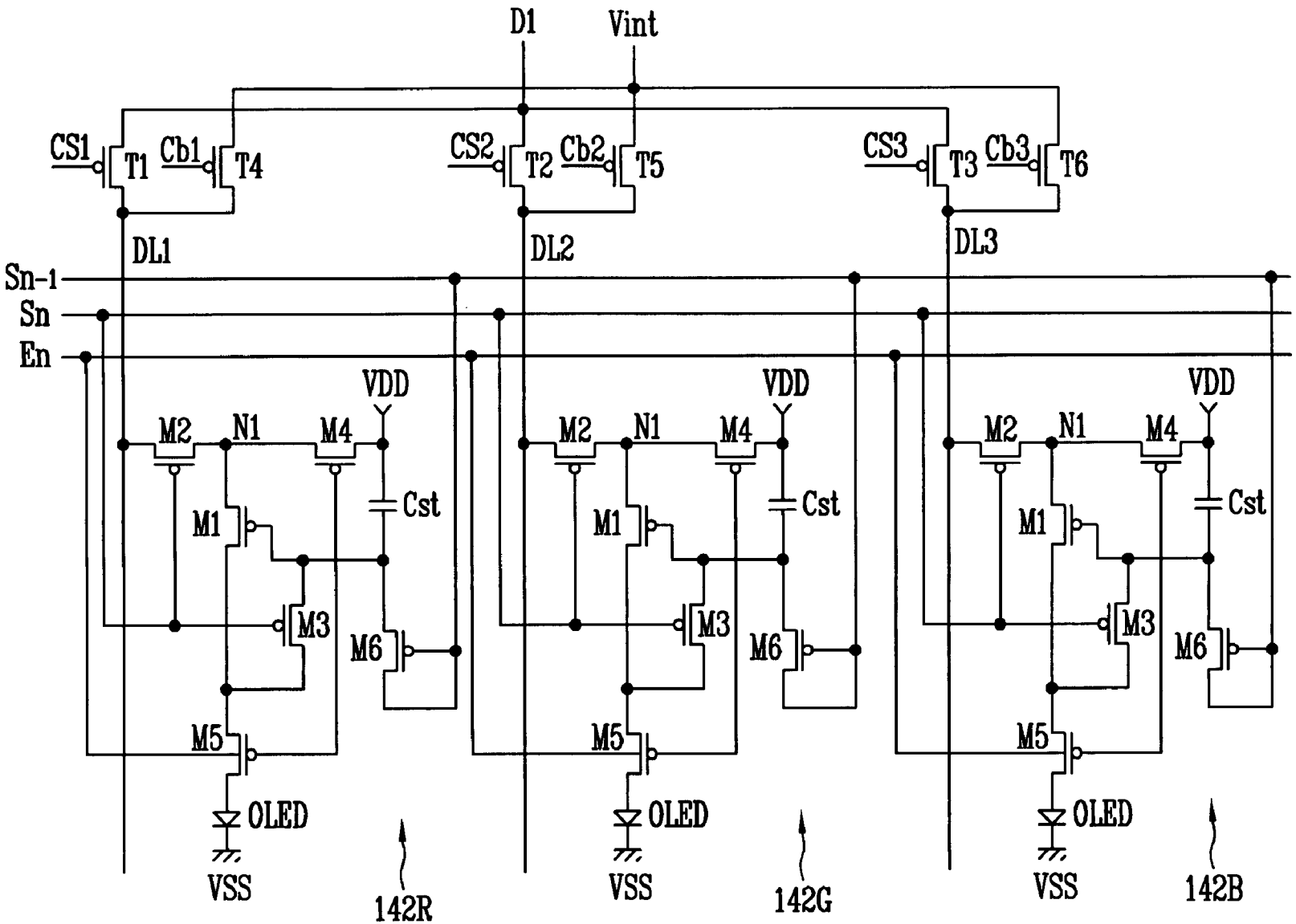
FIG. 7 is a diagram showing an arrangement where a demultiplexer, an initializer and some pixels are connected.

FIG. 7 is a diagram showing an exemplary arrangement where the demultiplexer, the initializer and pixels are connected. Here, assume that red R, green G, and blue B pixels are connected to one multiplexer (i.e., i=3). Further, FIG. 8 is a timing diagram showing driving waveforms supplied to scan lines, data lines, the initializer, and the demultiplexer.

Figure 8:
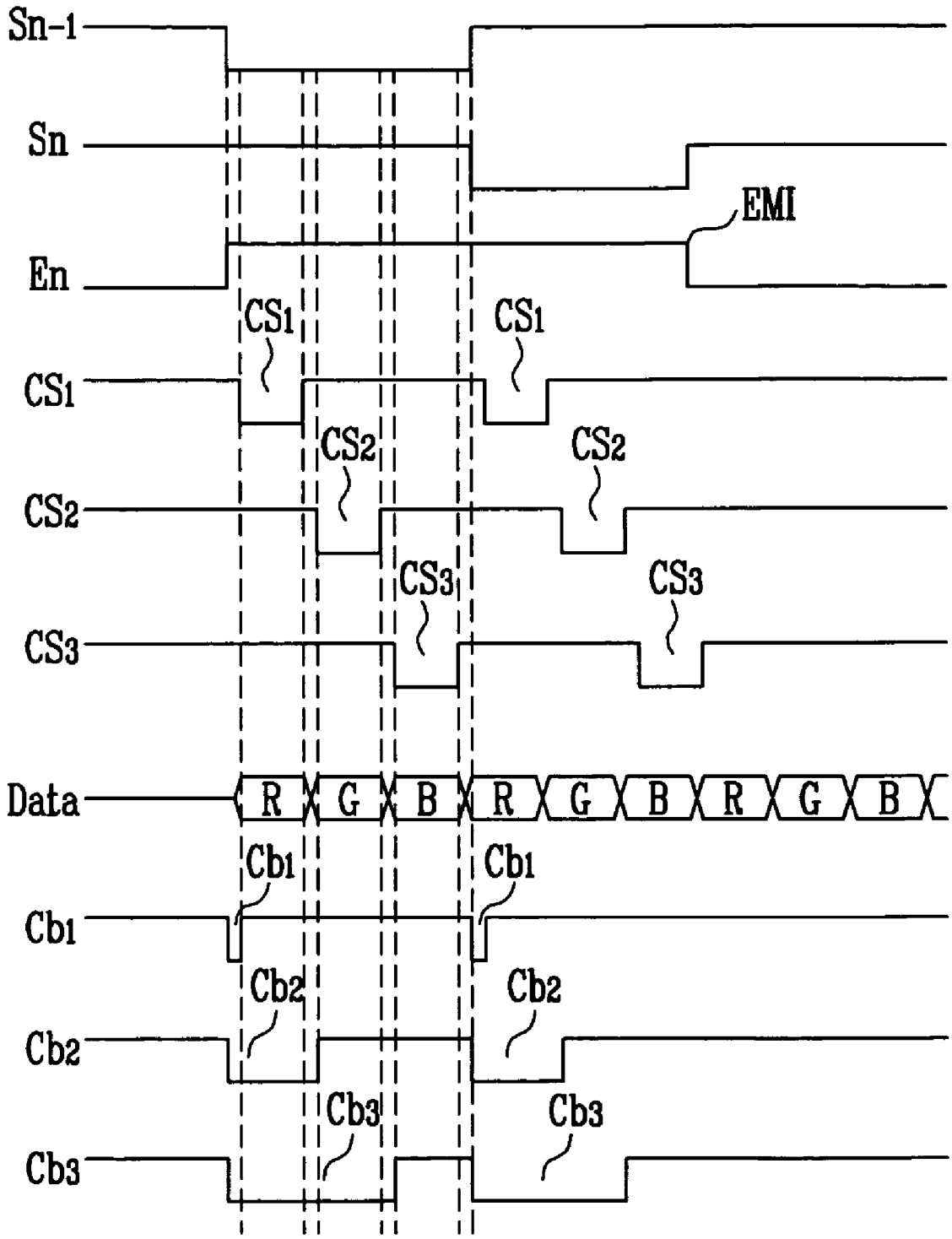
FIG. 8 is a timing diagram showing driving waveforms supplied to scan lines, data lines, an initializer, and a demultiplexer.

Referring to FIGS. 7 and 8, when the scan signal is supplied to the n−1th scan line Sn−1, the sixth transistors M6 included in the respective pixels 142R, 142G, and 142B are turned on. When the sixth transistor M6 in each respective pixel is turned on, the storage capacitor Cst and the gate terminal of the first transistor are connected to the n−1th scan line Sn−1. In other words, when the sixth transistor M6 is turned on, the scan signal is supplied to the storage capacitor Cst and the gate terminal of the first transistor M1 in each respective pixel is initialized.

The scan signal is then supplied to the next (nth) scan line Sn and the second transistor M2 and the third transistor M3 included in each of the pixels 142R, 142G, and 142B, are turned on. Further, in synchronization with the scan signal supplied to the nth scan line Sn, the first initialization control line Cb1, the second initialization control line Cb2, and the third initialization control line Cb3 are supplied as shown in FIG. 8. When the initialization control lines Cb1 to Cb3 are supplied, the fourth switching device T4 through the sixth switching device T6 are turned on.

When T4 to T6 are turned on, the voltage Vint is supplied to the first one of the second data line DL1 to the third one of the second data line DL3. The voltage Vint supplied to DL1 to DL3 is then supplied to the first node N1 of each of the pixels 142R, 142G, and 142B. Here, the gate terminal of the first transistor M1 included in each of the pixels 142R, 142G, and 142B remains at the voltage corresponding to the scan signal, as it is initialized by the scan signal supplied to the n−1th scan signal Sn−1.

When the initialization power supply voltage Vint1 is supplied to the first node N1, the first transistor M1 is turned on or off depending on the voltage value of Vint1. Here, the voltage of Vint1 is designated to be lower than the voltage of the data signal minus a threshold voltage of the transistors included in the pixel 140.

For example, when the first transistor M1 is turned on, the voltage of the gate terminal of the first transistors is changed to Vint1. Further, when the first transistor M1 is turned off, the voltage of the gate terminal of the first transistor M1 keeps the voltage of the scan signal.

Next, the first control signal CS1 is supplied to turn on the first switching device T1. Here, the supply of the first initialization control signal Cb1 is stopped before the first control signal CS1 is supplied, while the second initialization control signal Cb2 and the third initialization control signal Cb3 are continuously supplied to overlap with the first control signal CS1, as shown in FIG. 8.

When the first control signal CS1 is supplied, the first switching device T1 is turned on. When the first switching device T1 is turned on, the data signal supplied to the first data line D1 is supplied to the first node N1 of the first pixel 142R via the second transistor M2. When the voltage of the data signal is supplied to the first node N1, the first transistor M1 is turned on. In other words, the gate terminal of the first transistor M1 is driven by the voltage Vint1 or the scan signal, so that the first transistor M1 is turned on when the data signal is supplied to the first node N1. Accordingly, the data signal applied to the first node N1 is supplied to one side of the storage capacitor via the first transistor M1 and the third transistor M3. Subsequently, the voltage corresponding to the data signal is charged in the storage capacitor Cst.

Next, the first switching device T1 is turned off and the second switching device T2 is turned on by the second control signal CS1. Here, before the second control signal CS2 is supplied, the supply of the second initialization control signal Cb2 is stopped, while the third initialization control signal Cb3 is continuously applied to overlap with the second control signal CS2, as shown in FIG. 8.

When the second control signal CS1 is supplied, the second switching device T2 is turned on. When the second switching device T2 is turned on, the data signal supplied to the first one of the first data line D1 is supplied to the first node N1 of the second pixel 142G via the second transistor M2 and the first transistor M1 is turned on. In other words, the gate terminal of the first transistor M1 is driven by Vint1 or the scan signal, so that the first transistor M1 is turned on when the data signal is supplied to the first node N1. When the first transistor M1 is turned on, the data signal applied to the first node N1 is supplied to one side of the storage capacitor via the first transistor M1 and the third transistor M3 and the voltage corresponding to the data signal is charged in the storage capacitor.

Next, the second switching device T2 is turned off, and the third switching device T3 is turned on by the third control signal CS3. However, before the third control signal CS3 is supplied, the supply of the third initialization control signal Cb3 is stopped, as shown in FIG. 8.

When the third control signal CS3 is applied, the third switching device T3 is turned on and the data signal supplied to the first one of the first data line D1 is supplied to the first node N1 of the third pixel 142B via the second transistor M2. When the voltage of the data signal is supplied to the first node N1, the first transistor is turned on. In other words, the gate terminal of the first transistor M1 is driven by Vint1 or the scan signal, so that the first transistor M1 is turned on when the data signal is supplied to the first node N1. Accordingly, the data signal applied to the first node N1 is supplied to one side of the storage capacitor Cst via the first transistor M1 and the third transistor M3 and the voltage corresponding to the data signal is charged into the storage capacitor Cst.

As described above, the data signals supplied to one of the first data line D1 are then supplied to i second data lines DL by using the demultiplexer 162. Further, initialization switching devices are arranged to correspond to the data switching devices, and the initialization power supply voltage Vint is applied until the data signals are supplied to the respective second data line DL, thereby displaying stable desired images. In other words, the initialization switching devices are turned on simultaneously when the scan signals are applied, and are turned on substantially immediately before the data switching device is turned on, so that the voltage variation of the gate terminal of the first transistor M1 can be prevented, and accordingly, the desired images can be stably displayed.

Figure 9:
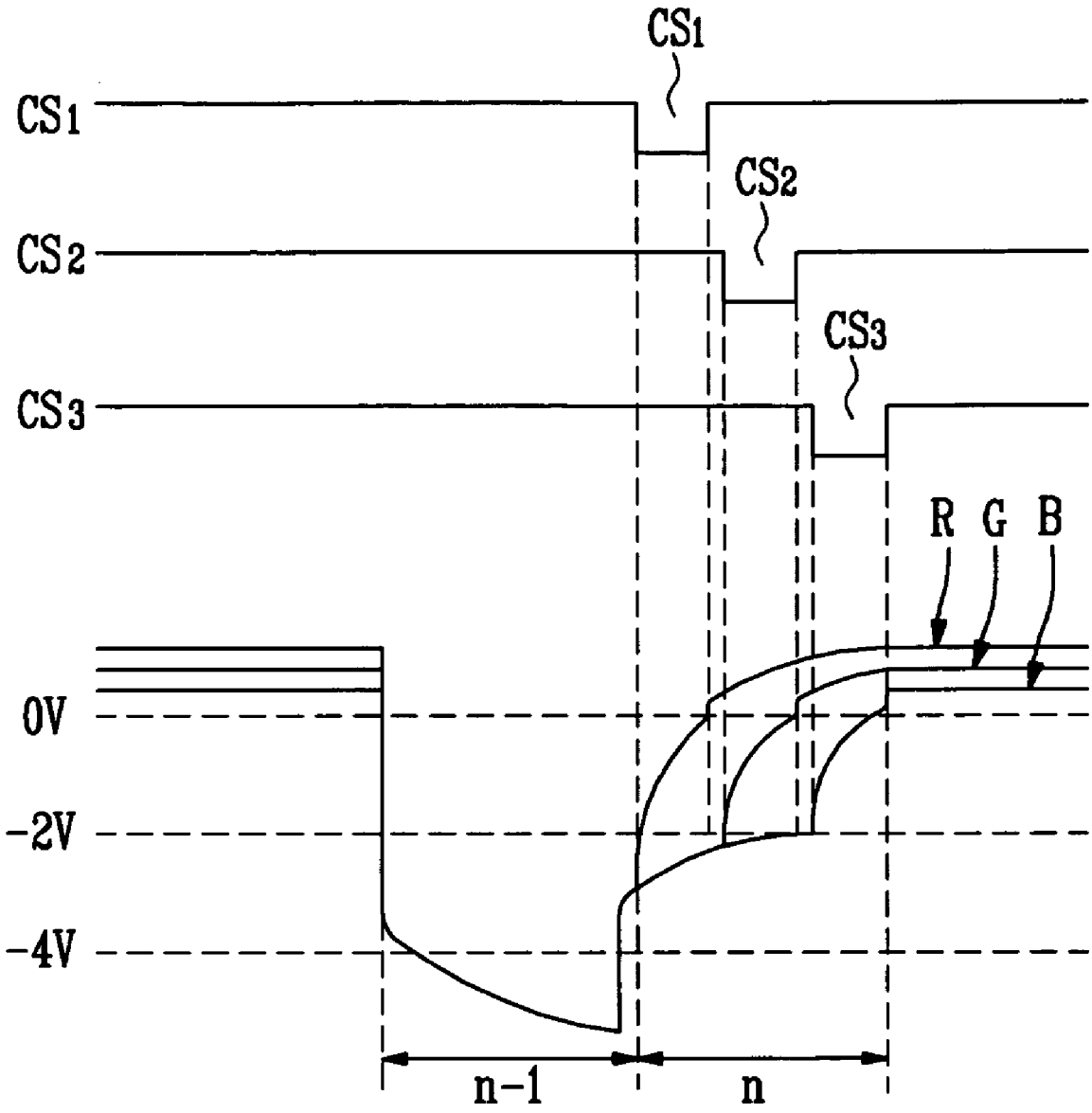
FIG. 9 is a diagram showing a voltage applied to a gate terminal of the first capacitor shown in FIG. 6.

FIG. 9 is a diagram showing a gate voltage of the first transistor when data signals having the same gray scale are supplied. Referring to FIGS. 7 to 9, first, when the scan signal is applied to the n−1th scan line Sn−1, the voltage of the gate terminal of the first transistors M1 included in the respective pixels 142R, 142G, and 142B is lowered to a voltage of the scan signal (e.g., a negative voltage). Further, when the scan signal is applied to the nth scan line Sn, the first control signal CS1 to the third control signal CS3 are sequentially supplied, and thus the data signals are supplied in the order of the first pixel 142R, the second pixel 142G, and the third pixel 142B.

When the first control signal CS1 is applied to turn on the first switching device T1, the voltage of the gate terminal of the first transistor M1 of the first pixel 142R is rapidly increased. Further, when the supply of the first control signal CS1 is stopped to turn off the first switching device T1, the voltage of the gate terminal of the first transistor M1 is further increased by a kick back voltage, as shown in FIG. 9.

More specifically, an equivalent parasitic capacitor is formed between the gate electrode and the drain electrode of the first switching device T1. Here, the kick back voltage is generated by the parasitic capacitor when the first switching device T1 changes from a turn-on state to a turn-off state, and the kick back voltage increases the gate voltage of the first transistor M1 of the first pixel 142R. When the first switching device T1 changes from the turn-on state to the turn-off state, a voltage across both ends of its parasitic capacitor Cgd is changed, so that the charges of the parasitic capacitor Cgd are redistributed to generate the kick back voltage.

When the second control signal CS2 is applied, the second switching device T2 is turned on. When the second switching device T2 is turned on, the voltage of the gate terminal of the first transistor M1 of the second pixel 142G is rapidly increased. Further, when the second control signal is applied, the first switching device T1 is turned on while the voltage of the gate terminal of the first transistor M1 of the first pixel 142R is continuously increased by the voltage charged in the parasitic capacitor equivalently formed in the first one of the second data line DL1. In addition, when the supply of the second control signal CS2 is stopped to turn off the second switching device T2, a kick back voltage further increases the voltage of the gate terminal of the first transistor M1 of the second pixel 142G, as shown in FIG. 9.

When the third control signal CS3 is applied, the third switching device T3 is turned on. When the third switching device T3 is turned on, the voltage of the gate terminal of the first transistor M1 included in the third pixel 142B is rapidly increased. Further, when the third control signal is applied, the first switching device T1 is turned on while the voltage of the gate terminal of the first transistors M1 included in the first pixel 142R and the second pixel 142G is continuously increased by the voltage charged in the parasitic capacitor equivalently formed in the second data line DL1 and DL2. In addition, when the supply of the third control signal CS3 is stopped to turn off the third switching device T3, a kick back voltage similar to the kick back voltages in the first and second switching devices further increases the voltage of the gate terminal of the first transistor M1 of the third pixel 142B, as shown in FIG. 9.

Figure 10:
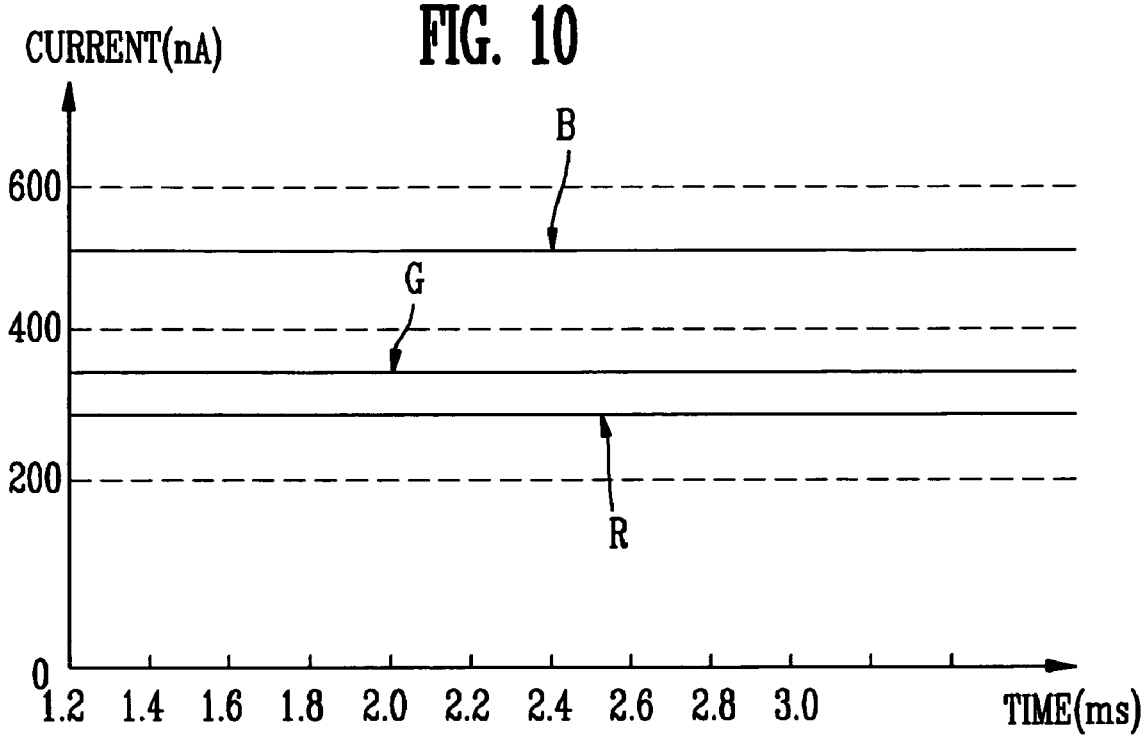
FIG. 10 is a diagram showing a current supplied to a light emitting diode by a voltage of the gate terminal shown in FIG. 9.

Next, when the supply of the scan signal is stopped, the first transistors M1 included in the first to third pixels 142R to 142B keep the voltage applied thereto. Here, the respective data signals are applied to the first, second and third pixels 142R to 142B at different times respectively, as shown in FIG. 9. Therefore, even when the data signals having the same gray scale are supplied to the i second data lines DL connected to the demultiplexer 162, light having different brightness is generated due to the timing difference of the data signals. In othet words, even when a data signal having the same gray scale is applied, the respective currents supplied to the light emitting diode (OLED) have different values, in response to the timing of the data signals, as shown in FIG. 10. This affects the brightness of displayed images.

Figure 11:
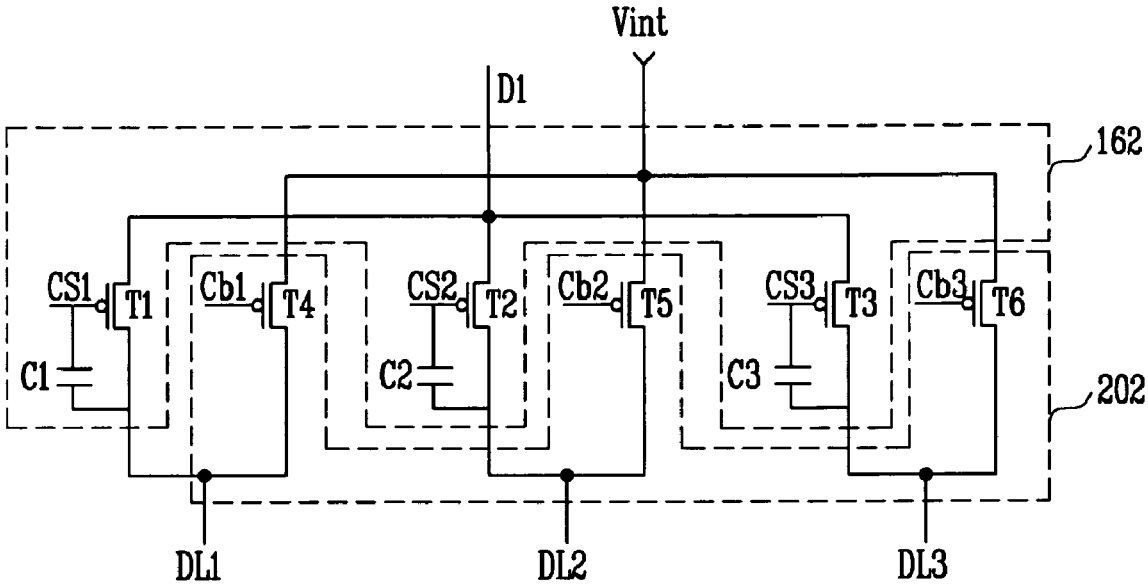
FIG. 11 is a circuit diagram showing a demultiplexer according to another embodiment of the present invention.

To overcome the shortcomings described above, a demultiplexer shown in FIG. 11 is proposed. FIG. 11 is a diagram showing a demultiplexer according to one embodiment of the present invention. While describing the demultiplexer of FIG. 11, the description of similar elements as those in FIG. 3 will be omitted.

Referring to FIG. 11 the demultiplexer 162 includes capacitors C1 to C3 arranged between gate terminals and drain terminals of the data switching devices T1 to T3, respectively.

The first capacitor C1 connected between the gate terminal and the drain terminal of the first switching device T1 (and the first one of the second data line DL1) increases the voltage supplied to the data line DL1 by a first voltage, when the first switching device T1 is turned off. Here, the first capacitor C1 has a first capacitance value.

The second capacitor C2 connected between the gate terminal and the drain terminal of the second switching device T2 (and the second one of the second data line DL2) increases the voltage supplied to the data line DL2 by a second voltage, when the second switching device T2 is turned off. Here, assuming that the turn on timing of the second switching device T2 is later than that of the first switching device T1, the voltage value of the second voltage is determined to be higher than the voltage value of the first voltage because, the second capacitor C2 has a second capacitance larger than the first capacitance.

The third capacitor C3 connected between the gate terminal and the drain terminal of the third switching device T3 (and the third one of the second data line DL3) increases the voltage supplied to the data line DL3 by a third voltage different from the first and second voltages, when the third switching device T3 is turned off. Here, assuming that the turn on timing of the third switching device T3 is later than that of the second switching device T2, the voltage value of the third voltage is determined to be higher than the voltage value of the second voltage because, the third capacitor C3 has a third capacitance larger than the second capacitance.

In fact, the capacitances of the capacitors C1, C2, and C3 connected between the gate terminal and the drain terminal of the data switching devices T1 to T3, respectively, are determined according to the turn on timings of the data switching devices T1 to T3. In other words, a switching device having a later turn on time is connected to the capacitor having a higher capacitance, while the switching device having an earlier turn on time is connected to the capacitor having a lower capacitance. Accordingly, when a capacitor having the capacitance that corresponds to a respective turn on timing is arranged at a respective gate terminal and the drain terminal of a respective data switching device in the demultiplexer 162, an image having an uniform brightness is displayed even with the different supply time of the data signal.

Figure 12:
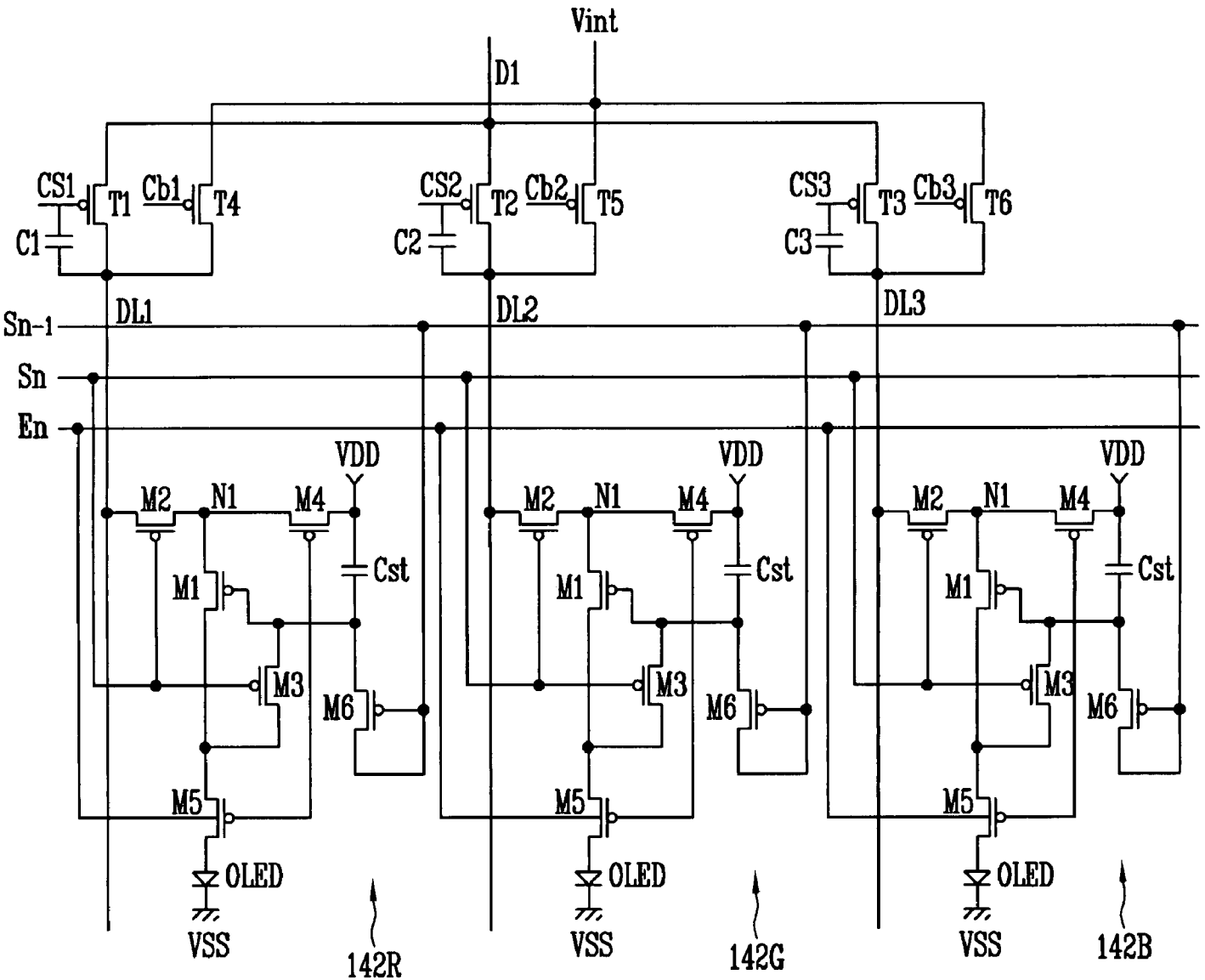
FIG. 12 is a diagram showing an arrangement where a demultiplexer, an initializer and some pixels are arranged.
Figure 13:
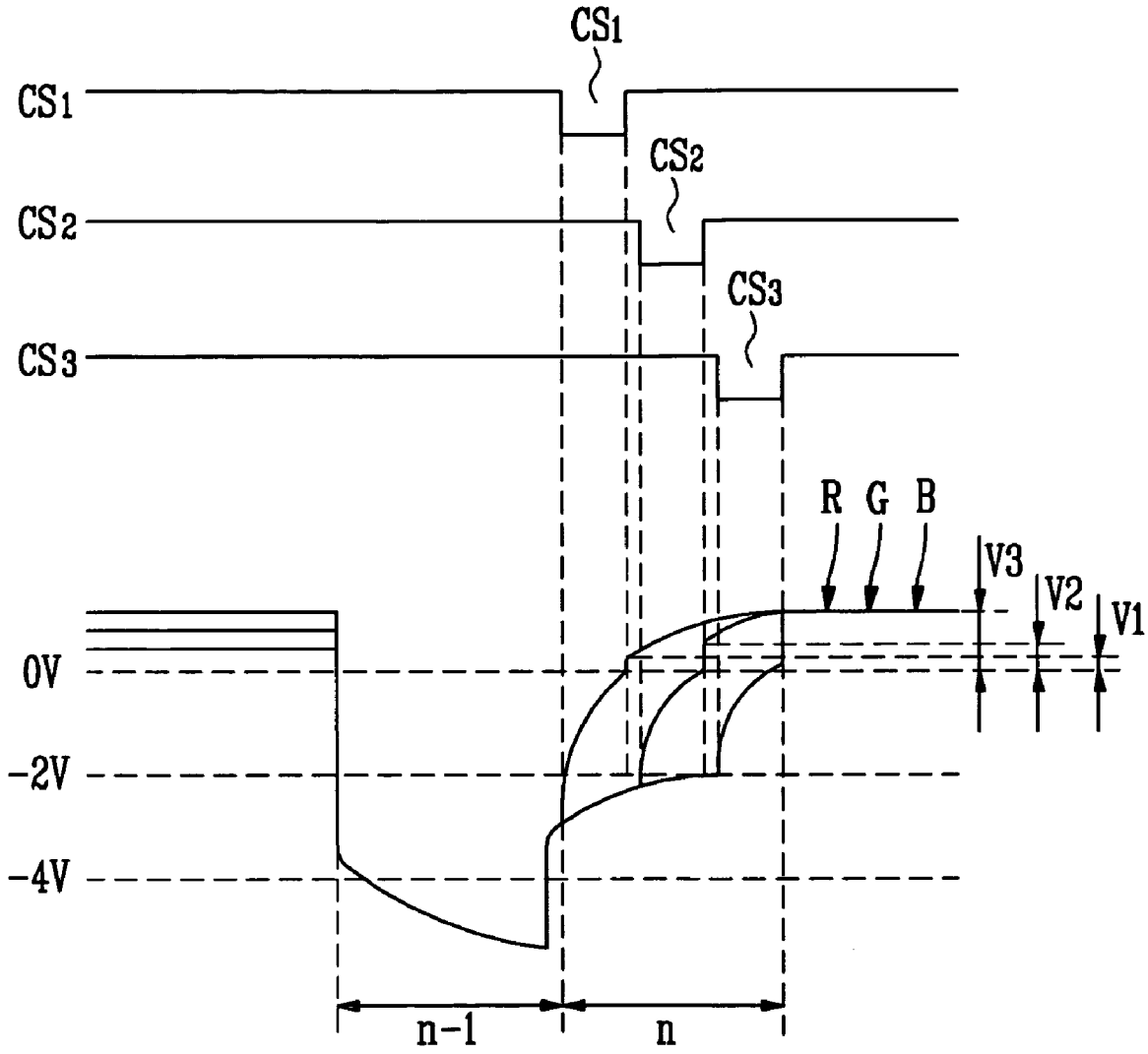
FIG. 13 is a diagram showing a voltage applied to the gate terminal of the first transistor shown in FIG. 6.

This is described in more detail with reference to FIG. 12. FIG. 12 is a diagram showing an arrangement where the demultiplexer FIG. 11 is coupled with the pixels. FIG. 13 is a diagram showing a gate voltage of the first transistor when the data signals having the same gray scales are supplied to the respective pixels.

Referring to FIGS. 12 and 13, first, when the scan signal is supplied to the n−1th scan line Sn−1, the voltage of the gate terminal of a respective first transistor M1 in a respective pixels 142R, 142G, and 14B is lowered to a voltage of the scan signal (e.g., a negative voltage). When the scan signal is supplied to the nth scan signal Sn, the first control signal CS1 to the third control signal CS3 are sequentially applied, and thus, the data signals are supplied in the order of the first pixel 142R, the second pixel 142G, and the third pixel 142B.

More specifically, first, the first control signal CS1 is applied to turn on the first switching device T1. When the first switching device T1 is turned on, the voltage of the gate terminal of the first transistor M1 in the first pixel 142R is increased. Further, at the time that the supply of the first control signal CS1 is stopped to turn off the first switching device T1, a kick back voltage further increases the voltage of the gate terminal of the first transistor M1. Here, since the first capacitor C1 has the first (lower) capacitance, the voltage of the gate terminal of the first transistor M1 is increased by a first voltage V1 corresponding to the first capacitance, as shown in FIG. 13.

Next, the second control signal CS2 is applied to turn on the second switching device T2. When the second switching device T2 is turned on, the voltage of the gate terminal of the first transistor M1 in the second pixel 142G is rapidly increased. In addition, at the time that the supply of the second control signal CS2 is stopped to turn off the second switching device T2, a kick back voltage further increases the voltage of the gate terminal of the first transistor M1. Here, since the second capacitor C2 has the second capacitance larger than the first capacitance, the voltage of the gate terminal of the first transistor M1 is increased by a second voltage V2, which is higher than the first voltage V1, as shown in FIG. 13.

Next, the third control signal CS3 is applied to turn on the third switching device T3. When the third switching device T3 is turned on, the voltage of the gate terminal of the first transistor M1 in the third pixel 142B is rapidly increased. In addition, at the time that the supply of the third control signal CS3 is stopped to turn off the third switching device T3, a kick back voltage further increases the voltage of the gate terminal of the first transistor M1. Here, since the third capacitor C3 has the third capacitance larger than the second capacitance, the voltage of the gate terminal of the first transistor M1 is increased by a third voltage V3, which is higher than the second voltage V2, as shown in FIG. 13.

Figure 14:
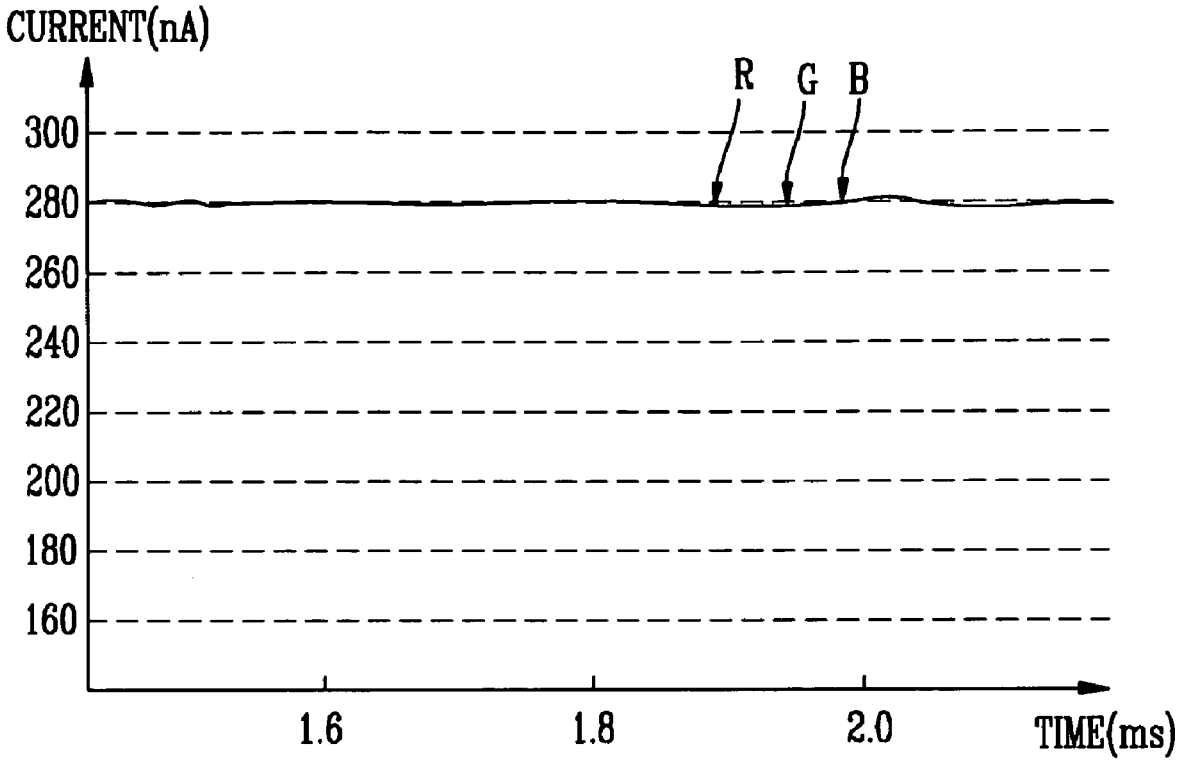
FIG. 14 is a diagram showing a current supplied to a light emitting diode by the voltage of the gate terminal shown in FIG. 13.

Consequently, as a respective data switching device is turned on later than a previous data switching device, the respective capacitance of the capacitor C is set to be larger so that images having uniform brightness can be displayed irrespective of the timing of the data signals. In other words, by providing a higher kick back voltage to the respective data switching devices T1, T2, and T3 as they turn on sequentially, the supply of the low voltage according to the subsequent data signal is compensated, thereby images having uniform brightness are displayed. The respective currents supplied to the light emitting diode (OLED), when the signals supplied to one of the first data line D is applied to the second data lines DL by using the demultiplexer, are shown in FIG. 14 (when the data signals having the same gray scales are applied). In one embodiment, the capacitances of the respective capacitors between the gate terminal and the drain terminal of each of the data switching devices T1, T2, and T3 are experimentally determined, according to the size and resolution of the image display portion.

As described above, according to an embodiment of the present invention, data signals supplied to one of the first data line are supplied to i second data lines by using a demultiplexer connected to a respective first data line so that the manufacturing cost is reduced. In addition, by adding capacitors having different capacitances to gate terminals and source terminals of i data switching devices in the respective demultiplexers, the images having uniform brightness are displayed.

Although a few embodiments of the present invention have been shown and described, it would be appreciated by those skilled in the art that changes might be made in these embodiments without departing from the principles and spirit of the invention, the scope of which is defined in the claims and their equivalents.

What is claimed is:

1. An organic light emitting display comprising:

a data driver for supplying a plurality of data signals to a plurality of first data lines, respectively;

an image display portion having a plurality of second data lines, a plurality of scan lines, and a plurality of pixels; and a demultiplexer having a plurality of data transistors arranged with the respective first data lines to supply the plurality of data signals supplied to the first data lines to the plurality of second data lines, and a plurality of capacitors connected between respective gate terminals of the plurality of data transistors and the second data lines.

2. The organic light emitting display according to claim 1, wherein the capacitor is connected between the gate terminal and a drain terminal of each data transistor.

3. The organic light emitting display according to claim 1, further comprising a demultiplexer controller for sequentially turning on the data transistors while scan signals are supplied to the scan lines, wherein the demultiplexer includes i data transistors as the data transistors, where i is a natural number of 2 or more.

4. The organic light emitting display according to claim 3, wherein the capacitors connected to the gate terminals of the respective data transistors have different capacitances.

5. The organic light emitting display according to claim 4, wherein the capacitance of a first capacitor of the capacitors is larger than a second capacitor of the capacitors that turns on after the first capacitor.

6. The organic light emitting display according to claim 3, wherein each of the plurality of pixels comprises a plurality of transistors and at least one of the transistors is connected in a diode configuration.

7. The organic light emitting display according to claim 6, wherein each pixel comprises:

an organic light emitting diode;

a first transistor for controlling a current supplied to the organic light emitting diode in response to a respective data signal;

a storage capacitor connected to the first transistor to charge a voltage corresponding to the respective data signal;

a second transistor connected to a scan line and a second data line to supply the respective data signal supplied from the second data line to the storage capacitor;

a third transistor controlled by the $n^{th}$ scan line and connected to a gate terminal and a drain terminal of the first transistor;

a fourth transistor and a fifth transistor controlled by a light emitting control line; and a sixth transistor having a gate terminal and a drain terminal connected to a previous scan line and a source terminal connected to the gate terminal of the first transistor.

8. The organic light emitting display according to claim 6, further comprising a plurality of initializers, each of the plurality of initializers comprising a same number of initialization transistors as the number of data transistors included in the demultiplexer, to apply a predetermined voltage to the respective second data lines.

9. The organic light emitting display according to claim 8, wherein the demultiplexer controller turns on the initialization transistors earlier than the respective data transistors, when the scan signals are supplied.

10. The organic light emitting display according to claim 9, wherein the demultiplexer controller turns off the initialization transistors at different times.

11. The organic light emitting display according to claim 10, wherein a respective initialization transistor of the initialization transistors is turned off before a respective data transistor of the data transistors connected to the same data line is turned on.

12. A demultiplexer comprising:

a plurality of transistors and a plurality of data lines, each of the plurality of transistors connected to a respective data line of the data lines to supply data signals to each of the respective data lines; and a plurality of capacitors, each connected between a gate terminal of a respective transistor of the transistors and the respective data line, wherein each of the capacitors has a different capacitance.

13. The demultiplexer according to claim 12, wherein the plurality of transistors sequentially are turned on to supply the data signals to the plurality of data lines.

14. The demultiplexer according to claim 13, wherein the capacitance of the capacitor is larger as the respective transistor is turned on later in the sequence.

* * * * *